US005517776A

United States Patent [19]

Knappe et al.

[11] Patent Number: 5,517,776

[45] **Date of Patent: * May 21, 1996**

[54] LAMINATED PRODUCT AND PROCESS FOR MAKING THE SAME

[75] Inventors: Robert T. Knappe, Castle Rock; John F. B. Prockter, Denver, both of Colo.

[73] Assignee: Apex Die & Box Company, Denver, Colo.

[ * ] Notice: The portion of the term of this patent subsequent to Jun. 26, 2012, has been disclaimed.

[21] Appl. No.: 360,700

[22] PCT Filed: Jun. 25, 1993

[86] PCT No.: PCT/US93/06204

§ 371 Date: Dec. 23, 1994

§ 102(e) Date: Dec. 23, 1994

[87] PCT Pub. No.: WO94/00833

PCT Pub. Date: Jan. 6, 1994

Related U.S. Application Data

[63] Continuation-in-part of Ser. No. 904,986, Jun. 26, 1992, Pat. No. 5,351,425.

[51] Int. Cl.[6] ..... G09F 1/12

[52] U.S. Cl. ..... 40/253; 40/281

[58] Field of Search ..... 40/152.1, 124.1, 40/155, 539; 229/92.8; 248/459; 428/78, 201, 202; 156/257, 268, 289, 290, 308.4

[56] References Cited

U.S. PATENT DOCUMENTS

| | | | |
|---|---|---|---|
| 2,172,273 | 9/1939 | Chilcote | 40/152.1 |
| 2,380,076 | 7/1945 | Scheyer | 40/152.1 |
| 2,496,884 | 2/1950 | Miles . | |
| 3,533,822 | 10/1970 | Bailey | 428/202 |
| 3,607,540 | 9/1971 | Hoogstoel . | |
| 4,626,309 | 12/1986 | Mullen, III et al. . | |
| 4,692,198 | 9/1987 | Borresen . | |
| 4,742,954 | 5/1988 | Shishido . | |
| 4,779,792 | 10/1988 | Lombardo | 229/73 |
| 4,867,828 | 9/1989 | McIntyre . | |
| 5,019,202 | 5/1991 | Kawahata et al. . | |
| 5,026,584 | 6/1991 | Logan . | |
| 5,047,103 | 9/1991 | Abrams et al. . | |

FOREIGN PATENT DOCUMENTS

| | | | |
|---|---|---|---|
| 534445 | 1/1955 | Belgium | 40/152.1 |
| WO89/06192 | 7/1989 | WIPO | 40/152.1 |

*Primary Examiner*—Joanne Silberman

*Attorney, Agent, or Firm*—Sheridan Ross & McIntosh

[57] ABSTRACT

A panel assembly incorporating a barrier layer to resist adhesion and a method for making the same are described. The panel assembly includes at least a front panel and a back panel arranged in a superimposed relationship. The barrier layer is disposed between selected areas of the front panel and the back panel to form a pocket, flap, or window to reduce bending, curling or warping of the panel assembly. The barrier layer can be applied by a high speed printing technique such as lithographic printing.

49 Claims, 6 Drawing Sheets

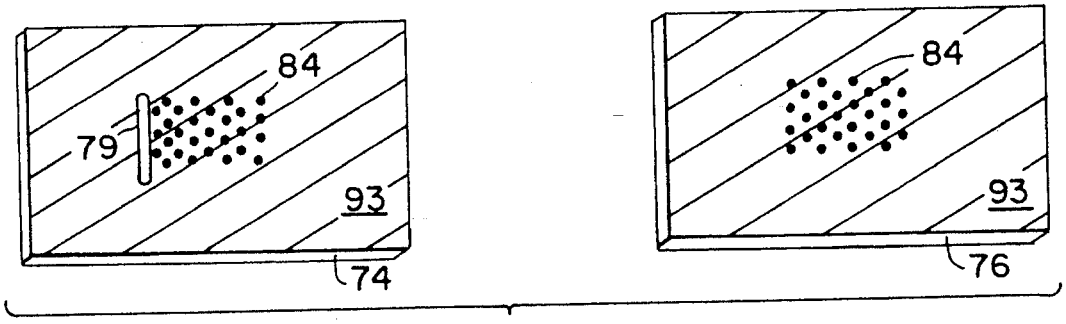
FIG.6d
FIG.6e
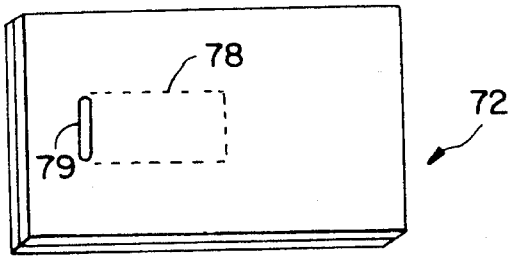
FIG.7
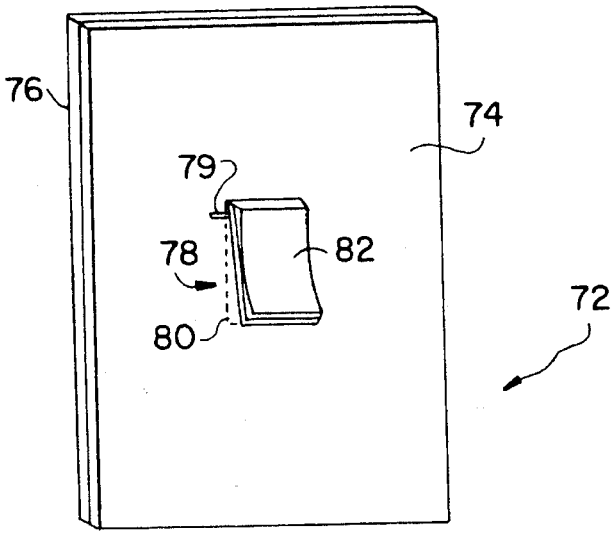

LAMINATED PRODUCT AND PROCESS FOR MAKING THE SAME

This application is a continuation-in-part of U.S. patent application Ser. No. 07/904,986 filed Jun. 26, 1992 entitled "DISPLAY DEVICE AND PROCESS FOR MAKING AND USING THE SAME", now issued as U.S. Pat. No. 5,351,425.

FIELD OF THE INVENTION

The present invention relates generally to laminated products formed from materials such as paper, cardboard, paperboard or the like and, in particular, to such laminated products incorporating a barrier layer to resist adhesion between selected portions of such products.

BACKGROUND OF THE INVENTION

Laminated products, i.e., products formed from layers of materials interconnected by mounting or other laminating technique, are utilized for a number of reasons. First, laminated products allow manufacturers to advantageously combine materials having different attributes or properties in a single product. For example, a laminated product such as a display device can include a backing formed from an inexpensive or sturdy material attached to a front panel formed from material which has the desired appearance or is easily processed. In addition, laminated products are useful where it is desirable to provide the product with a pull-out flap, window, pocket or the like. Examples of such devices include paperboard display devices having a fold-out easel such that the devices are self-standing, cardboard game pieces with pop-out windows which a contestant can remove to reveal prize information, packages provided with a flap which pulls out to form or provide access to a spout for pouring the package contents, and products which include a pocket, for example, to receive the flap of a paper pad or other items.

In forming a laminated product, the layers of the product are commonly attached using an adhesive. However, in some cases, adhesives are believed to be responsible for subsequent undesired warping, curling or bending of the laminated product. In particular, the adhesive can be partially absorbed into one or both of the layers being bonded causing the layer(s) to swell or otherwise become dimensionally unstable. Warping, curling or bending can occur in the finished product particularly where the layers are unequally affected by adhesive absorption, e.g., due to differences in porosity, fiber length or orientation, or other factors.

In addition, the process for producing laminated products incorporating a window, flap, pocket or the like is typically relatively complex, time-consuming and expensive. The case of paperboard display devices having a fold-out easel is illustrative. Such devices are commonly constructed from a front panel and an easel assembly which are adhesively interconnected, e.g., by applying glue therebetween, to form the display device. Often, the front panel is formed from a thick sheet of corrugated cardboard and has a forwardly facing display surface which can be formed from a separate label which is glued to the front panel. The easel assembly typically is formed from thick corrugated cardboard and includes flaps which can be deployed by folding the flaps rearwardly to provide support. As is readily appreciated, it is desirable to avoid adhesive attachment of the flap to adjacent portions of the display device so that the flaps can be easily deployed.

One known process for producing such paperboard display devices involves applying an adhesive across the extent of the interface between front panel and the easel assembly except for that portion of the interface where the easel flaps are located. Accordingly, glue can be applied to portions of the front panel or easel assembly around the flaps in a pattern which complements the shape of the flaps. Because glues are often tacky and highly viscous and therefore are poorly suited for certain high speed application techniques such as lithographic printing, the glue is commonly applied by silk-screening or a similar relatively slow and labor intensive process, thereby limiting production output and increasing production costs. Silk screening processes also result in usage of relatively large quantities of glue, further increasing production costs.

Manually coating panels with an adhesive by a process such as described above typically results in coating rates below about 120 panels per labor hour. Machines have been developed to mechanize the above-described process, including a machine known as the Automatan manufactured by Mirus Co. However, such machines are typically relatively expensive and are usually dedicated to particular coating applications, thereby increasing costs.

In addition, the resulting display device, including the front panel and the attached easel assembly, typically is not of uniform thickness due to the increased thickness of the device where the easel is attached. As a result, the display devices are clumsy to handle, take up a greater space during shipping and storage thereby increasing costs and can shift or fall during shipping or storage thereby creating a hazard. In this regard, shipping costs for such display devices can be up to $40,000 or more per 100,000 pieces. Moreover, a relatively large amount of corrugated cardboard is used in constructing such display devices thereby further increasing costs.

SUMMARY OF THE INVENTION

According to the present invention, laminated products incorporating a region which resists adhesion and methods for making the same are provided. A barrier material which resists adhesion between opposing panels of the product is provided to define the adhesion resistant region. The barrier material can be applied by various printing techniques including lithographic, gravure, letterpress, rotary screen or flexographic printing. It is an advantage of the present invention that the barrier layer can be applied by lithographic printing or other, preferably high speed, application techniques, thereby enhancing efficiency, economy and production rates. It is a further advantage of the present invention that undesired bending, curling or warping of the subject laminated product is reduced.

According to one aspect of the present invention, a laminated assembly is provided. The assembly includes first and second panels positioned in a superimposed relationship. The second panel includes a flap portion which is at least partially detachable from the remaining portion of the second panel. The flap portion may be totally removable from the assembly. An adhesive coating is disposed between the first and second panels and a barrier coating is disposed between the first panel and the flap portion, wherein the barrier coating resists adhesion between the flap portion and the first panel. The adhesive coating can be a layer of glue applied to the first panel and/or the second panel.

The barrier coating is preferably formed from a material which can be applied by lithography or a similar high speed coating technique. The barrier coating can have a room temperature, application viscosity between about 100 centipoise and 600 centipoise, or even higher values for certain applications such as screen printing. Preferably, the barrier coating has a room temperature, application viscosity between about 100 centipoise and 400 centipoise for lithographic printing. More preferably, the barrier coating has a room temperature, application viscosity no greater than about 200 centipoise. In addition, the barrier coating may be formed from an ultraviolet or infrared radiation curable, heat curable, or electron beam curable material or can be cured by blow drying or exposure to the ambient atmosphere. The barrier coating can advantageously be an aqueous based material to alleviate environmental concerns. As will be appreciated by those skilled in the art, such aqueous based materials can include non-aqueous components such as alcohol or ammonia, for example, to accelerate air drying or provide other desired characteristics.

According to another aspect of the present invention, a method for constructing a laminated assembly including first and second layers is provided. The method includes the steps of applying a barrier coating which resists adhesion in a selected pattern on one side of one of the layers, applying an adhesive coating to one side of one of the layers, and positioning the first and second layers in a superimposed relationship. In addition, the method includes the step of forming a line of weakness in one of the layers to define a detachable flap portion, wherein the flap portion and the barrier coating are arranged in a superimposed relationship in the assembly. The barrier coating can be applied by lithographically printing the barrier coating on one of the layers or by another printing technique. For example, the line of weakness can be formed by providing a continuous or perforated cut line in the first layer to define an outline of the flap.

According to a further aspect of the present invention, a method for use in displaying visual information is provided. The method includes the steps of providing a display device having front and rear sheets arranged in a face-to-face relationship, the front sheet including a display surface and the rear sheet including a fold-out easel portion, defined by a line of weakness, to provide support for the device in a standing position. The front and rear sheets are adhesively attached, wherein adhesion between the easel portion and the front sheet is substantially prevented by a barrier coating applied to the easel portion or the front sheet. The method includes the further steps of detaching the easel portion from a remaining portion of the rear sheet at the line of weakness, folding the easel portion rearwardly away from a plane of the rear sheet to an extended position wherein the easel portion is separated from the adhesive coating, and leaning the device against the easel portion in the extended position, wherein the easel portion supports the device such that the display surface is inclined for ease of viewing.

According to a further aspect of the present invention, a panel assembly is provided. The panel assembly comprises a first panel and a second panel positioned in a superimposed relationship with the first panel. The second panel includes an opening to provide access to a pocket between the panels. The assembly further includes an adhesive, disposed between the first and second panels, for adhesively interconnecting the panels and a barrier material, disposed between the first and second panels, for resisting adhesion between portions of the panels. The barrier material is selectively applied to certain desired areas in order to define the pocket between the panels.

It has been found that applying a single layer of barrier material can lead to undesired warping or curling of the completed assembly. The present inventors have found that this problem can be alleviated or eliminated by applying two separate patterns of barrier material that cooperate to define an area where the panels are separable.

Accordingly, in another aspect of the present invention, a panel assembly including first and second patterns of a barrier material which resists adhesion is provided, wherein the first and second patterns define an area where the panels are separable. The assembly includes a first panel and a second panel positioned in a superimposed relationship. An adhesive is disposed between the first and second panels for adhesively interconnecting the panels. The first pattern of barrier material is disposed between the adhesive and a first portion of the first panel. The second pattern of barrier material is disposed between the adhesive and a second portion of the second panel. The first and second patterns of barrier material thereby cooperatively define the area where the first and second panels are separable. In cooperatively defining this area, the first and second patterns can be formed in complementary shapes, have regions of overlap, or even allow some areas of adhesion which can be overcome to separate the panels as desired.

According to a further aspect of the present invention, a method for constructing an assembly including first and second panels is provided. The method includes the steps of: applying a first barrier material which resists adhesion in a first selected pattern on the first panel and applying a second barrier material which resists adhesion in a second selected pattern on the second panel wherein the first and second barrier materials are shaped to cooperatively define an area where the panels are separable. The method further includes the steps of applying an adhesive coating to at least one of the panels and positioning the panels in a superimposed relationship such that the panels are adhesively interconnected.

According to a still further aspect of the present invention, a panel assembly is provided which reduces undesired bending, curling or warping. The assembly includes first and second panels disposed in a superimposed relationship and interconnected with an adhesive, where at least one of the panels is dimensionally unstable upon absorbing a portion of the adhesive. For example, one of the panels may be more affected by moisture than the other. A barrier material is disposed in a selected pattern between the first and second panels to resist adhesion. For many applications, it is believed that adequate protection against bending, curling or warping will be provided by positioning the barrier material between the adhesive and the layer which is most affected by absorption of the adhesive. In this manner exposure to moisture is reduced and some degree of relative movement between the panels is allowed.

The laminated products of the present invention can be used in many applications. Examples include self-standing display devices, display devices incorporating pockets, windows, flaps or deployable members for enhancing rigidity, containers incorporating spouts or the like and tray puzzles or other devices incorporating deployable or detachable components.

BRIEF DESCRIPTION OF THE DRAWINGS

FIG. 6*d* is a perspective view of the panels of FIG. 6*a* after application of adhesive coatings;

FIG. 6*e* is a perspective view of the panels of FIG. 6*a* after the panels have been adhesively attached together;

FIG. 7 is a perspective view of an apparatus constructed in accordance with a still further embodiment of the present invention;

DETAILED DESCRIPTION OF THE PREFERRED EMBODIMENT

Figure 1:
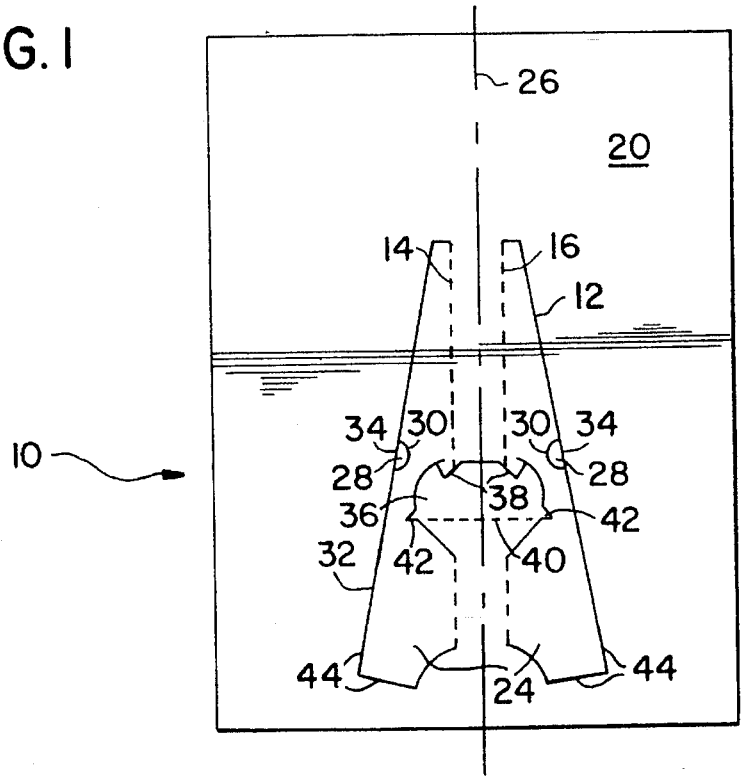
FIG. 1 is a back view of an apparatus constructed in accordance with the present invention.
Figure 2:
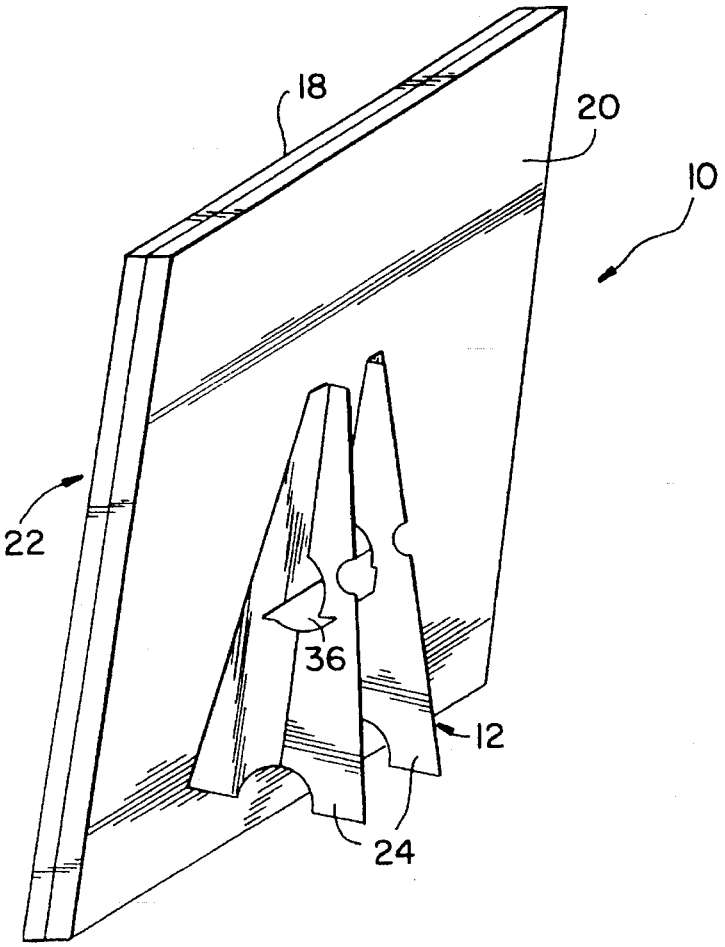
FIG. 2 is a perspective view of the apparatus of FIG. 1 with the easel in a deployed position.
Figure 3:
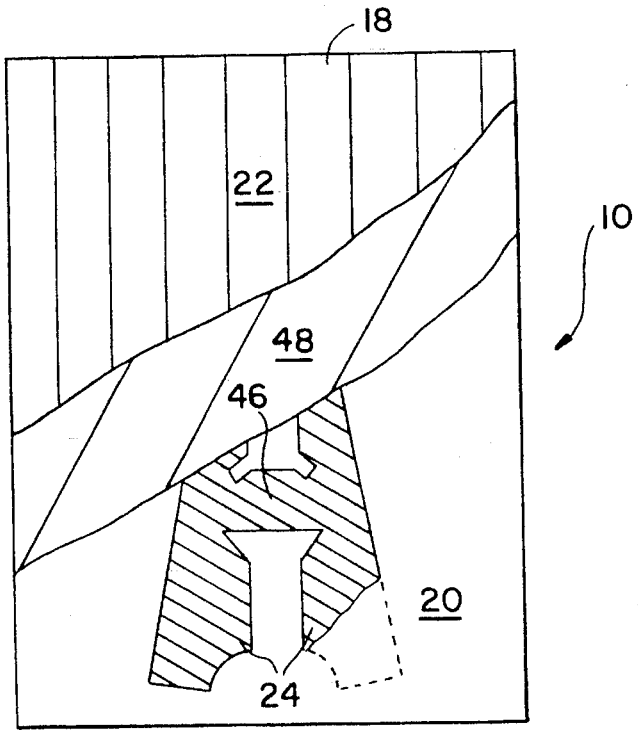
FIG. 3 is a cutaway front view of the apparatus of FIG. 1 with various layers partially removed for illustration purposes.

Referring to FIGS. 1–3, a device constructed in accordance with the present invention is generally identified by the reference numeral 10. Generally, the device 10 comprises a laminate constructed from panels, e.g., sheets or webs, and includes at least one flap, window or pocket of any shape. The panels can be constructed from papers, polymers and/or other materials. Preferably, the panels are formed from fibrous materials such as paper, wood, cardboard, paperboard or other paper stock. In the illustrated embodiment, the device 10 comprises a display device including an extendible easel portion 12 which can be extended by folding the easel portion 12 rearwardly from the device 10, e.g., by pivotably folding the easel portion 12 about axes 14 and 16, such that the easel portion 12 supports the device 10 in an inclined, standing position as shown in FIG. 2.

The device 10 includes front 18 and rear 20 panels arranged in a superimposed relationship. The panels 18 and 20 can be formed from a material such as cardboard, paperboard or the like which is sufficiently stiff so as to be suitable for use in a self-supporting display device. In addition, the front panel 18 can be provided with a front, display surface 22 (separate or integral) capable of receiving printed matter, e.g., promotional information. The illustrated panels 18 and 20 can be formed from 24 point paperboard which is suitable for a variety of self-supporting display device applications. It will thus be appreciated that the device 10 can be conveniently and safely stored and shipped in a substantially planar configuration thereby also reducing costs. For example, typical shipping costs for certain prior art devices can be $40,000 for 100,000 pieces. The present invention can reduce such costs by 50%, thereby saving $20,000. Further, use of corrugated cardboard is typically reduced 30% to 50%. The panels 18 and 20 may be provided with a coating to reduce absorption of materials applied thereto, thus further reducing production costs.

As noted, the easel portion 12 can be provided as a portion of the rear panel 20. The easel portion 12 is positioned and shaped so that the device 10 can lean on the easel portion 12 for support when the easel portion 12 is extended. In this regard, it will be appreciated that many shapes and positions of the easel portion 12 are possible. For example, a single, triangular flap, appropriately positioned, could be utilized to provide support for the device 10. The illustrated easel portion 12 includes a pair of generally triangular flaps 24 arranged in a mirror image relationship about a centerline 26 of the panel 20. This arrangement has been found to provide excellent standing stability for the device 10.

The illustrated easel portion 12 includes a number of other useful features. For example, the easel portion 12 includes tabs 28 to facilitate folding of the easel portion 12 to the extended position. The tabs 28 can comprise generally semi-circular, partially cut-out portions of the easel portion 12 sized to allow the user to insert a finger therethrough. The illustrated tabs 28 are defined by lines of weakness 30 through panel 20 extending nearly around tabs 28 and terminating a short distance before edges 32 of flaps 24. The lines 30 can, for example, be continuous or perforated cut-lines formed by die-cutting or other cutting technique. It will thus be appreciated that the tabs 28 can be pivotably folded about axis 34 such that the user can pull on tabs 28 or insert a finger underneath flaps 24 adjacent tabs 28 to facilitate folding of the easel portion 12 to an extended position.

The easel portion 12 also includes a flap 36 for securing the easel portion 12 in the extended position. As shown, the flap 36 has a generally semi-circular shape including a pair of generally triangular indentations 38. The flap 36 is foldable about axis 40 such that the indentations 38 can securingly receive corresponding indentations 42 of flaps 24 when the easel portion 12 is in the extended position. The flaps 24 and 36 are defined by lines of weakness 44 in or through panel 20, shown as solid lines in FIG. 1, which can be continuous or perforated cutlines formed by die-cutting or other cutting technique.

The panels 18 and 20 are adhesively interconnected in a manner such that the easel portion 12 does not stick to the front panel 18. This can be accomplished according to the present invention by applying a barrier layer 46 which resists adhesion between the easel portion 12 and the front panel 18 as shown. As will be appreciated upon consideration of the description below, the barrier layer material can additionally be applied even in portions of the areas where adhesion is desired to reduce bending, curling or warping. The barrier layer 46 can be applied to either panel 18 or 20 or to both panels 18 and 20. In this regard, application of the barrier layer 46 to both panels 18 and 20 can reduce the likelihood of undesired bending, curling or warping of the device 10. Similarly, the adhesive coating 48 can be applied on the front panel 18 and/or the back panel 20. It is an advantage of the present invention that the adhesive coating 48 can be applied across the extent of the interface between the panels 18 and 20 such that it is unnecessary to apply the adhesive coating 48 in a pattern so as to avoid bonding the easel portion 12 to the front panel 18. It will thus be appreciated that the adhesive coating 48 can be simply applied through spray coating, roller coating, or other high speed coating technique. Any suitable adhesive, for example, the adhesives identified by product codes OG2-37188 or 37117BX manufactured by Swift, can be utilized in accordance with the present invention. In a preferred embodiment, the adhesive is water soluble and is non-toxic upon curing.

The dimensions of the device 10 can vary broadly. The device 10 is preferably about 3 inches to 3 feet wide and 5 inches to 10 feet tall. The easel portion 12 is preferably between about ¼ and ¾ the height of the device 10 and preferably extends perpendicularly from the device 10 a distance of about 5% to 50% of the height of the device 10. In addition, the lower extremity of the easel portion 12 should be located a distance from the bottom of the device 10 of about 5% to 20% of the height of the device 10. The illustrated device 10 is about 18 inches wide and 30 inches tall. The easel portion 12 is about 19–20 inches tall and extends about 4–5 inches from the device when deployed. The easel portion 12 is positioned about 4–5 inches from the bottom of the device 10.

The barrier layer 46 is composed of a material which resists adhesion. Thus, for example, the barrier layer 46 can provide a hard, substantially adhesive impermeable coating. Other desirable characteristics of the barrier layer 46 include the following. The barrier layer 46 can be curable, e.g., by ultraviolet or infrared radiation, heat or an electron beam, to ensure that the barrier layer 46 is cured quickly and completely thereby facilitating construction of the device 10. If desired, the barrier layer may simply be cured by exposure to the ambient atmosphere or by blow drying. In addition, the barrier layer 46 can be suitable for application by a variety of printing techniques, including direct or offset techniques, such as screen, letterpress, lithographic, flexographic and gravure printing. Preferably, the barrier layer 46 is applicable by lithographic printing or similar high speed application techniques to enhance production speed and allow high speed construction without necessitating provision of an expensive machine dedicated to application of the barrier layer 46. It has been found that the barrier layer 46 can be lithographically printed in accordance with the present invention at rates greater than 3,500 prints per hour. In this regard, the barrier layer 46 should be formed of a material which has a low application viscosity, preferably below about 400 centipoise and more preferably below about 200 centipoise. Additionally, the barrier layer 42 can be formed from an aqueous based material to alleviate environmental concerns. Suitable barrier layer materials include various waterbased emulsions and acrylic type materials such as, for example, MIRACUREJ9312D manufactured by Pierce and Stevens and Algan 3305.

It will thus be appreciated that the device 10 can be quickly and simply constructed in accordance with the present invention without the need for an expensive machine dedicated to particular coating procedures. In this regard, it is noted that printing equipment utilized to apply the barrier layer 46 can be utilized for other printing applications. In addition, where the manufacturer does not desire to purchase additional equipment, the barrier layer 46 can be printed off-site, e.g., by an independent printer in accordance with the present invention.

Figure 4:
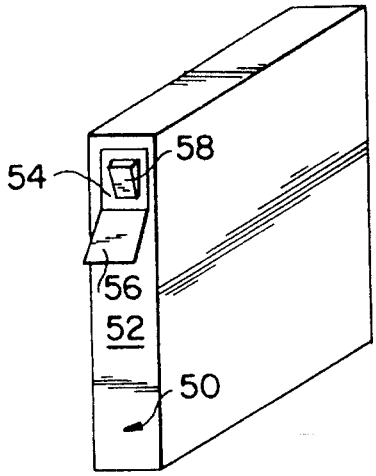
FIG. 4 is a perspective view of an apparatus constructed in accordance with an alternative embodiment of the present invention.
Figure 5:
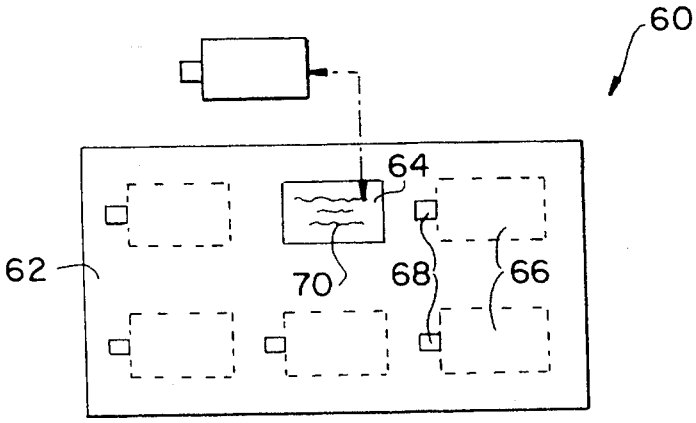
FIG. 5 is a front view of an apparatus constructed in accordance with a further alternative embodiment of the present invention.

Referring to FIGS. 4 and 5, alternative embodiments of the present invention are shown. FIG. 4 shows a box side panel portion 50 formed from front 52 and rear 54 panels wherein the front panel 52 is provided with a flap 56 to allow access to a pouring spout 58. It will be appreciated that a construction technique as described herein may be utilized to form the side panel portion 50 so that the flap 56 can be easily opened without undesired adhesion between the flap 56 and rear panel 54. Similarly, FIG. 5 shows a gamepiece 60 formed from front 62 and rear 64 panels of fibrous material including a number of removable windows 66 and associated pull tabs 68. The gamepiece 60 can be used in connection with a sweepstakes wherein a contestant removes a window 66 to reveal prize information 70. The gamepiece 60 can be constructed using a technique such as described herein. Other embodiments of the present invention could include, for example, gameboards or picture-books that have pop-up figures.

Figure 8:
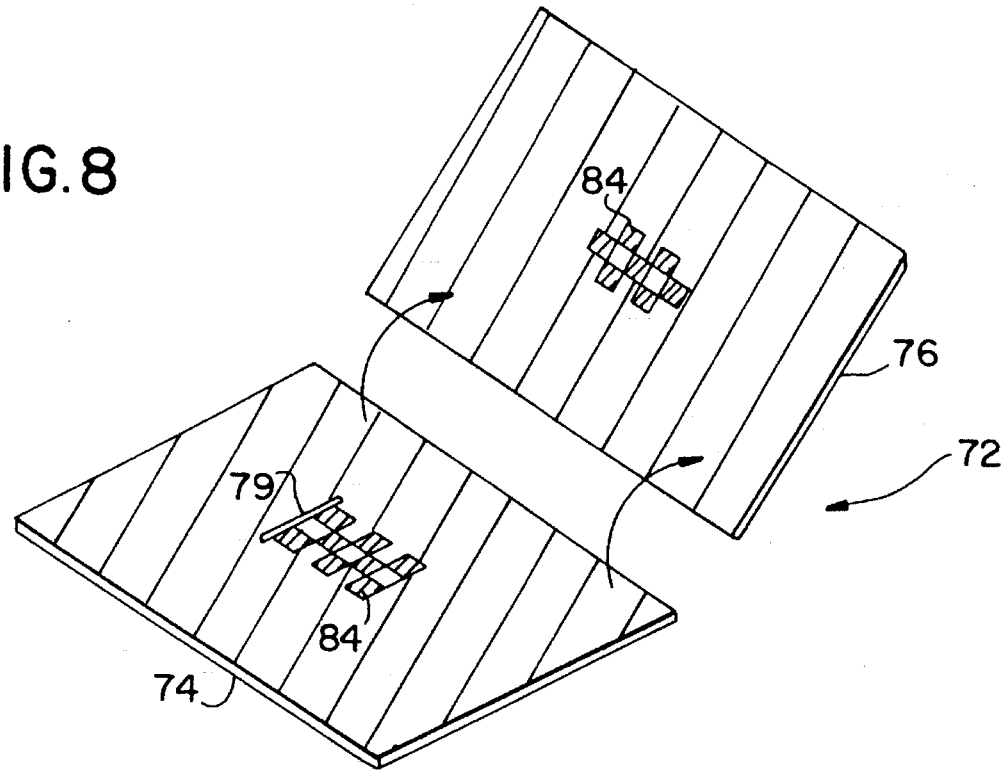
FIG. 8 is a perspective view of the apparatus of FIG. 7 with the front and back panels separated for purposes of illustration to show a possible barrier layer application pattern.
Figure 9:
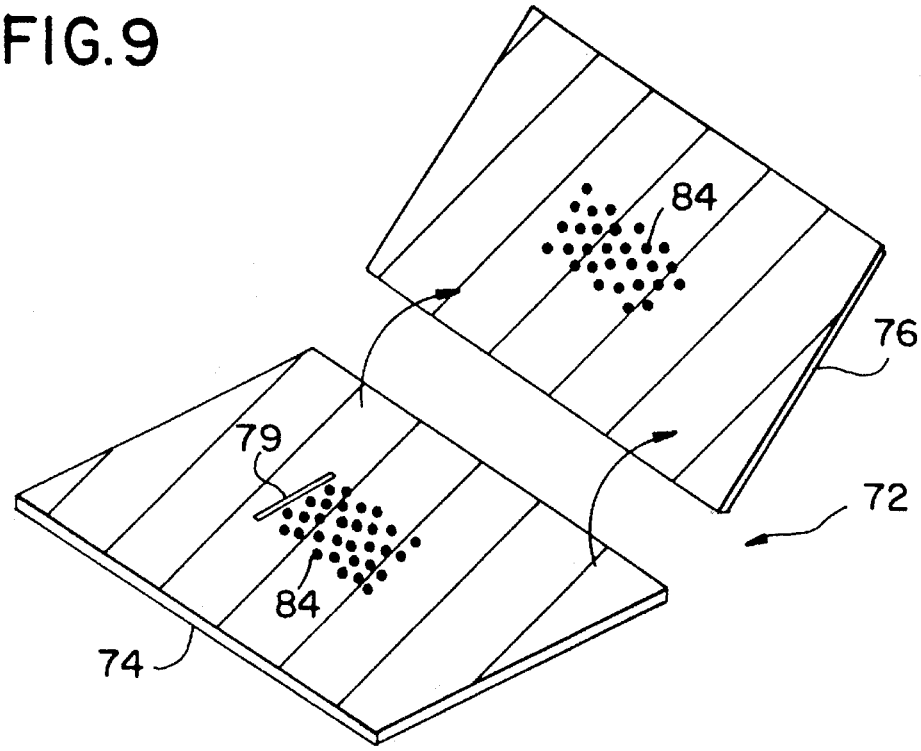
FIG. 9 is a perspective view of the apparatus of FIG. 7 with the front and back panels separated for purposes of illustration to show another possible barrier layer application pattern.

Referring to FIGS. 7–9, a panel assembly constructed in accordance with a further embodiment of the present invention is generally identified by the reference numeral 72. The panel assembly 72 includes a front panel 74 and a back panel 76 wherein a pocket 78, e.g., for receiving a flap 80 of a flapped article 82 is formed between the panels 74 and 76. An opening 79 to allow insertion of the flap 80 into the pocket 78 is provided in at least one of the front panel 74 and back panel 76. In this manner, the flapped article 82 can be supportably carried by the panel assembly 72.

The flapped article 82 can be any article which includes a flap 80 which can be used to support the article. Examples of such articles which can be advantageously supported by the panel assembly 72 include pads of paper, folders, clipboards, boxes and the like. In this regard, the pocket 78 can include collapsible side walls which allow the assembly to be shipped and stored in a collapsed, substantially planar configuration and then expanded to provide a pocket having a depth sufficient to accommodate a variety of objects. Alternatively, a collapsible or non-collapsible tray having at least one flap can be provided separately and the flap can then be tucked into a pocket or pockets of the assembly 72. For example, the tray may have two flaps, one along each side of the tray, which are insertable into corresponding pockets of the assembly 72 for support. In the illustrated embodiment, the flapped article 82 is a pad of paper which can, for example, include advertising information.

FIGS. 8 and 9 show the panel assembly 72 with the front panel 74 and back panel 76 separated to show two exemplary ways in which barrier material 84 can be applied so as to define the pocket area. As noted above, it is advantageous in some applications to apply the barrier material 84 to both the front panel 74 and back panel 76 of the panel assembly 72 so as to reduce the likelihood of undesired warping, curling or bending of the panel assembly 72. This can be accomplished by applying barrier material 84 across the extent of the pocket area on both panels 74 and 76 or by applying barrier material 84 in selected patterns on each panel 74 or 76 as shown in FIGS. 8 and 9. In the latter regard, the patterns of barrier material 84 applied to the opposing panels 74 and 76 can be formed in complementary shapes, have regions of overlap, or even allow some areas of adhesion. FIG. 8 shows barrier material 84 applied in complementary patterns on the front 74 and back 76 panels so as to cooperatively define the pocket area. It will be appreciated that any complementary patterns could be utilized. FIG. 9 shows discontinuous layer patterns of barrier material 84 applied, for example, by half-tone printing, to each of the front 74 and back 76 panels to cooperatively define the pocket area. Such discontinuous layer patterns may allow some adhesion between the panels 74 and 76 in storage or shipping, but such adhesion can be easily overcome to permit insertion of the flap 80 into the pocket 78. In this regard, the layer patterns preferably cooperatively cover at least 90% of the pocket area and, more preferably, cover at least 98% of the pocket area. It will be appreciated that these barrier material applications can be utilized in connection with any of the embodiments of the present invention.

Figure 6A:
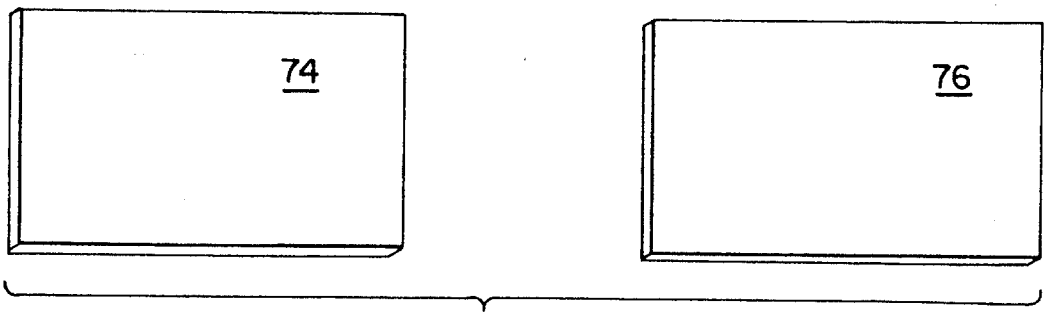
FIG. 6*a* is a perspective view of two panels.
Figure 6B:
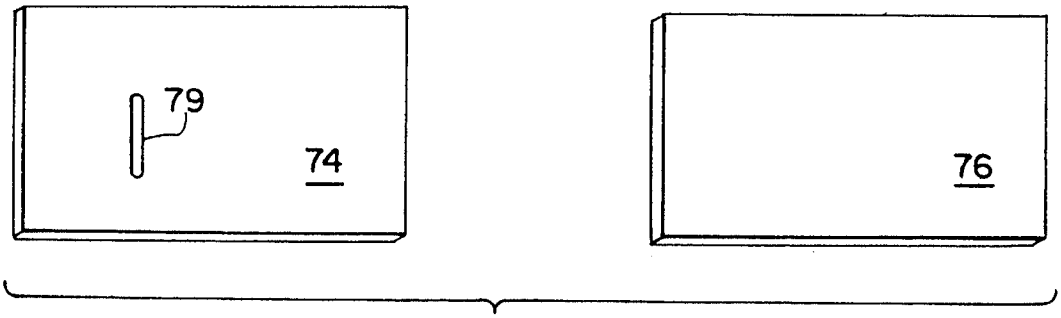
FIG. 6*b* is a perspective view of the panels of FIG. 6*a* after an opening is formed in one of the panels.
Figure 6C:
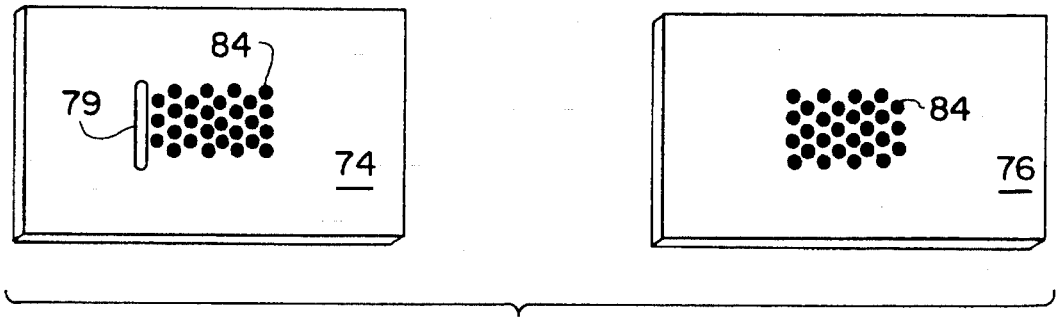
FIG. 6*c* is a perspective view of the panels of FIG. 6*a* after application of barrier coatings.

Referring to FIGS. *6a–6e*, the panel assembly 72 can thus be constructed in an in-line process as follows. The panels 74 and 76 shown in FIG. *6a* can be provided as pre-cut sheets or from a web of stock material. As shown in FIG. *6b*, opening 79 is provided through at least one of the panels 74 and 76 to allow access to the pocket 78 (see FIG. 7). The barrier material 84 can be applied by lithographically or otherwise printing the barrier material 84 on the front 74 or rear panel 76, or onto both panels 74 and 76 as shown in FIG. 6c. Thereafter, the barrier material 84 can be cured, e.g., by irradiation with ultraviolet or infrared radiation, heat, or an electron beam or by air or blow drying. A coating 93 of glue can be applied to the front 74 and/or rear 76 panels by spray coating, roller coating or other high speed coating technique, and then the panels 74 and 76 can be positioned in a superimposed relationship and pressed together by rollers, pressure plates or the like. The opening 79 can be cut, by die cutting, knife cutting or other technique, preferably before, but alternatively after the panels 74 and 76 are coated and attached together.

Figure 10:
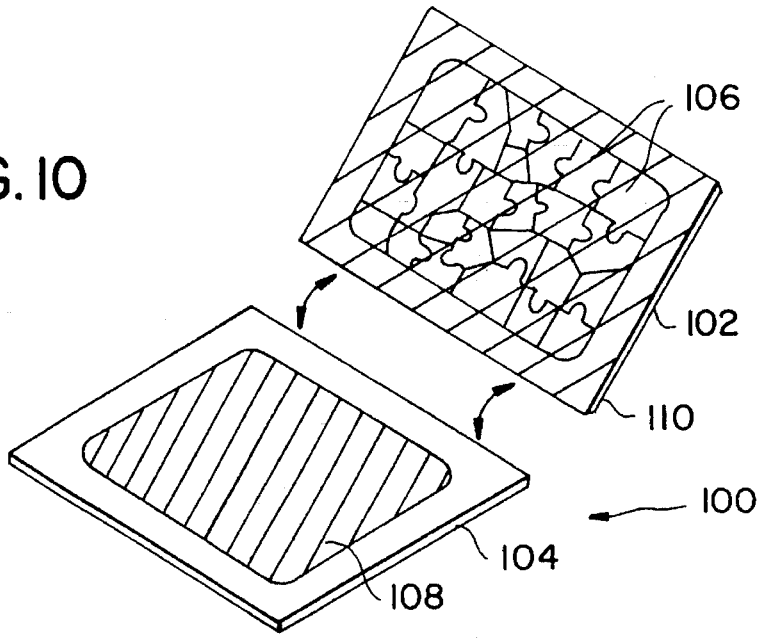
FIG. 10 is a perspective view of an apparatus constructed in accordance with a further alternative embodiment of the present invention with the front and back panels separated for illustration purposes.

Referring to FIG. 10, a tray puzzle 100 constructed in accordance with the present invention is shown. The puzzle comprises a front panel 102 incorporating jigsaw puzzle pieces 106 and rear panel 104. In FIG. 10, the front 102 and rear 104 panels are shown separated for illustration purposes. It will be appreciated that the front 102 and rear 104 panels are interconnected with an adhesive 110 in a manner which allows for removal of the pieces 106. The tray puzzle 100 thus constructed is advantageous in that it incorporates a built-in tray which allows for easy movement of the puzzle 100.

In accordance with the present invention, the tray puzzle 100 is constructed by using a barrier layer 108 as described above to resist adhesion between the puzzle pieces 106 and rear panel 104. The barrier layer 108 can be applied between the adhesive 110 and the puzzle pieces (e.g., by applying the barrier layer 108 to the back side of the puzzle pieces) or, as illustrated, between the adhesive layer and the rear panel 104 over an area corresponding to the puzzle pieces 106.

Figure 11:
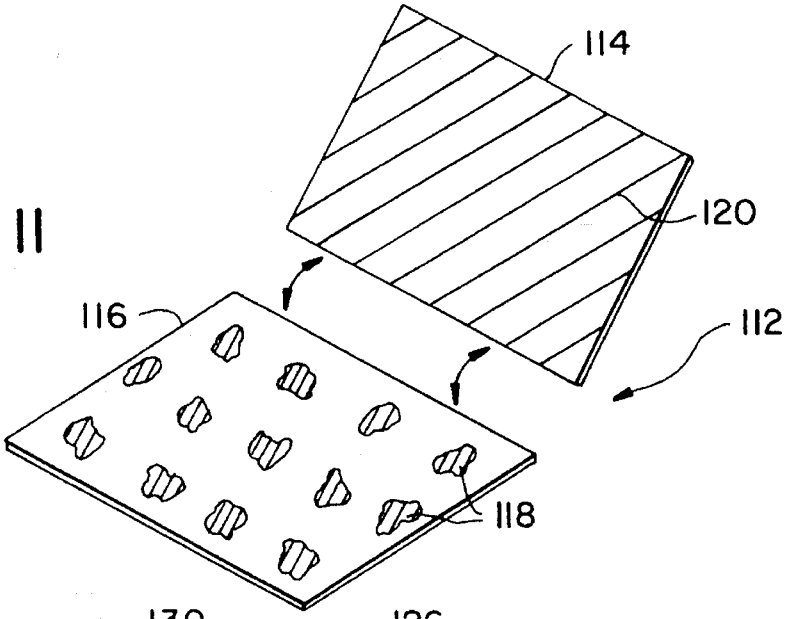
FIG. 11 is a perspective view of an apparatus constructed in accordance with a still further alternative embodiment of the present invention with the front and back panels separated for illustration purposes.

A panel assembly 112 constructed in accordance with a further alternative embodiment of the present invention is illustrated in FIG. 11 with the front 114 and rear 116 panels thereof separated for illustration purposes. As noted above, a problem which is frequently encountered in connection with laminated products is the tendency of the products to bend, curl or warp because the panels are unequally affected upon absorbing a portion of the adhesive. It has been found that such bending, curling or warping can be reduced in accordance with the present invention by providing a barrier material as described above between opposing panels of a laminated product so as to define a region where at least one of the panels is protected against adhesive absorption. It is believed that this enhances dimensional stability and allows some degree of relative movement between the panels thereby alleviating the tendency of the product to bend, curl or warp.

Referring to FIG. 11, a barrier material 118 is disposed on at least one of the panels 114 or 116 in a selected pattern so as to define at least one region where the panels 114 and 116 are attached by the adhesive 120. The pattern and placement of the barrier material 118 is preferably selected to minimize bending, curling or warping of the assembly 112. In this regard, the barrier material can be applied to the panel 114 or 116 which is most affected by absorption of the adhesive 120, e.g., the material which swells the most upon absorption. Additionally, the selected pattern can be varied depending upon the porosity of the associated panel, the size and orientation of the panel fibers, or other factors known to affect dimensional stability. In the illustrated embodiment, the adhesive 120 is applied across the extent of the front panel 114 and the barrier material 118 is applied in a number of patches spaced about rear panel 116 in a staggered relationship. Such a configuration allows for good adhesion between the panels 114 and 116 while achieving the advantages described above. The present inventors have surprisingly found that the present invention can thus reduce bending, curling or warping by up to 80–90% or more.

Figure 12:
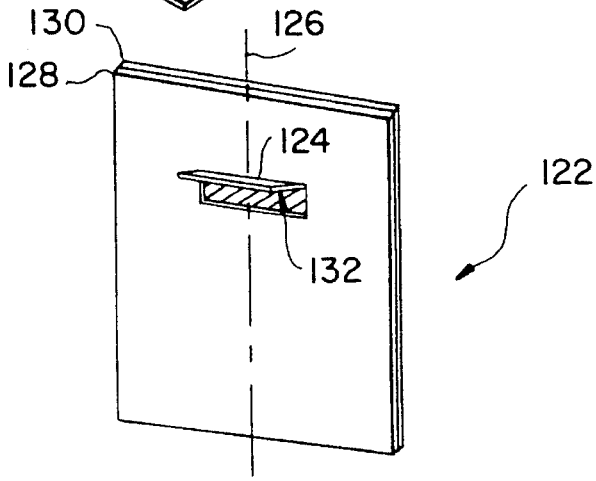
FIG. 12 is a perspective view showing an apparatus constructed in accordance with yet another alternative embodiment of the present invention.

A perspective view of a further panel assembly 122 constructed in accordance with the present invention is shown in FIG. 12. The illustrated assembly 122 depicts another manner of addressing the problem of undesired bending, curling or warping. Certain materials, such as recycled cardboard and paperboard materials which are increasingly popular, are particularly susceptible to bending, curling or warping. Specifically, sheets of such materials are susceptible to bending about their longitudinal axis. This problem is addressed in the illustrated assembly 122 by providing a flap 124 which extends from the assembly 122 so as to provide enhanced rigidity. As shown, the flap 124 is oriented transversely to the longitudinal axis 126 of the assembly 122. Again, a barrier material may be utilized for ease of construction of the assembly 122. The barrier material is applied between the front 128 and rear 130 panels of the assembly 122 in the area of the flap 124, e.g., applied to the back surface 132 of the flap 124, to resist adhesion between the flap 124 and rear panel 130. In this manner, the assembly can be conveniently shipped in a planar configuration and then the flap can be deployed to achieve the desired rigidity.

While various embodiments of the present invention have been described in detail, it is apparent that further modifications and adaptations of the invention will occur to those skilled in the art. However, it is to be expressly understood that such modifications and adaptations are within the spirit and scope of the present invention.

What is claimed is:

1. A panel assembly, comprising:

a) a first panel;

b) a second panel positioned in a superimposed relationship with said first panel, said second panel including a first portion which is at least partially detachable from a remaining portion of said second panel;

c) an adhesive coating, capable of being applied as a viscous fluid, disposed between said first and second panels, said adhesive coating bonding said first panel to said second panel wherein said first and second panels remain bonded by said adhesive coating when said first portion is at least partially detached; and d) a barrier coating, disposed between said first panel and said first portion and extending substantially entirely across an interface between said first panel and said first portion, said barrier coating resisting adhesion between said first portion and said first panel.

2. The assembly of claim 1, wherein each of said first and second panels comprises a sheet of paper stock.

3. The assembly of claim 1, wherein said assembly is a display device and said first portion is foldable rearwardly from said second panel to provide support for said device.

4. The assembly of claim 1, wherein said first portion is defined by a line of weakness to facilitate detachment of said first portion from said remaining portion of said first panel.

5. The assembly of claim 1, wherein said first portion is adapted to pivot relative to a plane of said second panel.

6. The assembly of claim 1, wherein said first portion is entirely detachable from a remaining portion of said second panel.

7. The assembly of claim 1, wherein said adhesive coating comprises glue applied to said first panel.

8. The assembly of claim 1, wherein said adhesive coating comprises glue applied to said second panel.

9. The assembly of claim 1, wherein said barrier coating comprises a material having a room temperature, application viscosity no greater than about 600 centipoise.

10. The assembly of claim 1, wherein said barrier coating comprises a material having a room temperature, application viscosity of no greater than about 200 centipoise.

11. The assembly of claim 1, wherein said barrier coating comprises an ultraviolet radiation curable material.

12. The assembly of claim 1, wherein said barrier coating comprises an infrared radiation curable material.

13. The assembly of claim 1, wherein said barrier coating comprises a heat curable material.

14. The assembly of claim 1, wherein said barrier coating comprises an electron beam curable material.

15. The assembly of claim 1, wherein said barrier coating comprises a lithographically printable material.

16. A method for constructing an assembly including first and second panels, comprising the steps of:

a) applying a barrier coating which resists adhesion in a selected pattern on one of said first and second panels;

b) applying an adhesive coating as a viscous fluid to one of said first and second panels;

c) positioning said first and second panels in a superimposed relationship, such that said first and second panels are bonded together by said adhesive coating; and d) forming a line of weakness in said second panel, said line defining a first portion of said second panel which is at least partially detachable from a remaining portion of said second panel, wherein said first portion and said barrier coating are arranged in a superimposed relationship in said assembly and said barrier coating extends substantially entirely across said first portion to resist adhesion of said first portion to said first panel.

17. The method of claim 16, wherein said step of applying a barrier coating comprises lithographically printing said barrier coating on said first panel.

18. The method of claim 16, wherein said step of forming a line comprises cutting said first panel to define an outline of said first portion.

19. The method of claim 16, further comprising the step of curing said barrier coating by exposing said barrier coating to ultraviolet radiation.

20. The method of claim 16, further comprising the step of curing said barrier coating by exposing said barrier coating to infrared radiation.

21. The method of claim 16, further comprising the step of curing said barrier coating by exposing said barrier coating to heat.

22. The method of claim 16, further comprising the step of curing said barrier coating by exposing said barrier coating to an electron beam.

23. The assembly constructed in accordance with the method of claim 16.

24. A method for use in displaying visual information, comprising the steps of:

a) providing a display device comprising front and rear panels arranged in a face-to-face relationship, said front panel including a display surface and said rear panel including a fold-out easel portion, defined by a line of weakness, to provide support for said device in a standing position, said front and rear panels being adhesively attached by an adhesive coating, capable of being applied as a viscous fluid, wherein adhesion between said easel portion and said front panel is substantially prevented by a barrier coating applied at an interface therebetween and extending across said interface;

b) employing said barrier coating and said line of weakness to detach said easel portion from a remaining portion of said rear panel by applying a rearward force to said easel portion;

c) progressively folding said easel portion rearwardly away from a plane of said rear panel to an extended position wherein said easel portion is separated from said front panel; and d) leaning said device against said easel portion in said extended position, wherein said easel portion supports said device such that said display surface is inclined for ease of viewing.

25. A panel assembly, comprising:

a) a first panel;

b) a second panel positioned in a superimposed relationship with said first panel, said second panel including an opening for providing access to a pocket between said first and second panels;

c) adhesive means, capable of being applied as a viscous fluid, disposed between said first and second panels, for adhesively interconnecting said first and second panels, said adhesive coating bonding said first panel to said second panel at areas separate from an area of said pocket; and d) barrier means, disposed between said first and second panels, for resisting adhesion therebetween, said barrier means extending across said pocket area between said first and second panels.

26. The panel assembly of claim 25, wherein each of said first and second panels comprises a sheet of paper stock.

27. The panel assembly of claim 25, wherein said adhesive means comprises glue applied to said first panel or said second panel.

28. The panel assembly of claim 25, wherein said barrier means comprises a material having a room temperature, application viscosity no greater than about 600 centipoise.

29. The panel assembly of claim 25, wherein said barrier means comprises a material having a room temperature, application viscosity of no greater than about 200 centipoise.

30. The panel assembly of claim 25, wherein said barrier means comprises an ultraviolet radiation curable material.

31. The panel assembly of claim 25, wherein said barrier means comprises an infrared radiation curable material.

32. The panel assembly of claim 25, wherein said barrier means comprises a heat curable material.

33. The panel assembly of claim 25, wherein said barrier means comprises an electron beam curable material.

34. The panel assembly of claim 25, wherein said barrier means comprises a lithographically printable material.

35. The panel assembly of claim 25, wherein said barrier means comprises an air curable material.

36. The panel assembly of claim 25, wherein said barrier means comprises an aqueous material.

37. A panel assembly, comprising:

a ) a first panel;

b ) a second panel positioned in a superimposed relationship with said first panel;

c) adhesive means, disposed between said first and second panels, for adhesively interconnecting said first and second panels;

d) first barrier means, disposed between said adhesive means and a first portion of said first panel, for resisting adhesion between said first and second panels; and e) second barrier means, disposed between said adhesive means and a second portion of said second panel, for resisting adhesion between said first and second panels, said first and second barrier means cooperatively defining an area wherein said first and second panels are separable.

38. The panel assembly of claim 37, wherein said first and second barrier means are formed in complementary shapes to cooperatively define said area.

39. The panel assembly of claim 37, wherein each of said first and second barrier means comprises material applied in a pattern extending substantially over the extent of said area.

40. A panel assembly, comprising:

a) a first panel;

b) a second panel positioned in a superimposed relationship with said first panel, said second panel including an opening for providing access to a pocket between said first and second panels;

c) adhesive means disposed between said first and second panels for adhesively interconnecting said first and second panels;

d) first barrier means for resisting adhesion between said first and second panels disposed between said adhesive means and a first portion of said first panel; and e) second barrier means for resisting adhesion between said first and second panels disposed between said adhesive means and a second portion of said second panel, said first and second barrier means cooperatively defining a pocket between said first and second panels.

41. A method for constructing an assembly including first and second panels, comprising the steps of:

a) applying a first barrier means which resists adhesion in a first selected pattern on said first panel;

b) applying a second barrier means which resists adhesion in a second selected pattern on said second panel, said first and second barrier means shaped to cooperatively define an area wherein said first and second panels are separable;

c) applying an adhesive coating to at least one of said first and second panels; and d) positioning said first and second panels in a superimposed relationship such that said first and second panels are adhesively interconnected.

42. The method of claim 41, wherein said step of applying a first barrier means comprises lithographically printing said first barrier means on said first panel.

43. The method of claim 41, further comprising the step of curing said barrier coating by exposing said barrier coating to ultraviolet radiation, infrared radiation, heat, or an electron beam.

44. The method of claim 41, further comprising the step of curing said barrier coating by exposing said barrier coating to air.

45. A panel assembly, comprising:

a) first and second panels positioned in a superimposed relationship and an adhesive applied between said first and second panels as a viscous fluid for interconnecting said first and second panels, at least one of said first and second panels being dimensionally unstable upon absorbing a portion of said adhesive; and b) barrier means for resisting penetration of said adhesive, said barrier means disposed in at least one selected area between said first and second pane, wherein said barrier means inhibits deformation of said panel assembly due to adhesive related dimensional instability.

46. The assembly of claim 45, wherein said first panel is dimensionally unstable upon absorbing a portion of said adhesive and said barrier means is disposed between said adhesive and said first panel.

47. The assembly of claim 45, wherein said barrier means is applied between said first and second panels in a pattern selected to reduce bending of said panel assembly.

48. The assembly of claim 45, wherein said barrier means is applied in a plurality of locations spaced about the interface of said first and second panels.

49. A panel assembly, comprising:

a) a first continuous panel;

b) a second continuous panel positioned in a superimposed relationship with said first panel;

c) adhesive means, disposed in a first area between said first and second panels, for adhesively interconnecting said first and second panels; and d) barrier means, disposed in a second area between said adhesive means and said first panel for resisting adhesion between said first and second panels, said second area being smaller than said first area and being aligned with said first area such that said first and second panels are adhesively interconnected about substantially the entire periphery of said second area wherein said barrier means defines a region between said first and second panels which is substantially free from adhesive interconnection, said region further being substantially free of access from outside said panel assembly.

* * * * *